US008107653B2

(12) United States Patent
Wolfe

(10) Patent No.: US 8,107,653 B2
(45) Date of Patent: Jan. 31, 2012

(54) GARMENT WITH BUILT-IN AUDIO SOURCE WIRING

(75) Inventor: James Wolfe, Venice, CA (US)

(73) Assignee: Jerry Leigh of California, Inc., Van Nuys, CA (US)

( * ) Notice: Subject to any disclaimer, the term of this patent is extended or adjusted under 35 U.S.C. 154(b) by 394 days.

(21) Appl. No.: 12/492,035

(22) Filed: Jun. 25, 2009

(65) Prior Publication Data

US 2010/0329499 A1 Dec. 30, 2010

(51) Int. Cl.
*H04R 25/00* (2006.01)

(52) U.S. Cl. ..... 381/301; 381/333; 381/384

(58) Field of Classification Search ..... 381/300, 381/301, 309, 333, 370, 374, 376, 384, 385, 381/388; 2/209.13, 209, 906; 379/430; 455/100, 455/575.1, 575.6; 181/129, 130, 135
See application file for complete search history.

(56) References Cited

U.S. PATENT DOCUMENTS

| | | | | |
|---|---|---|---|---|
| 1,329,029 | A | | 1/1920 | Timmons |
| 1,354,524 | A | | 10/1920 | Timmons |
| 2,156,504 | A | | 5/1939 | Liss |
| 2,282,830 | A | | 5/1942 | Scudder et al. |
| 2,285,083 | A | | 6/1942 | Cover |
| 4,070,553 | A | | 1/1978 | Hass |
| 4,321,433 | A | | 3/1982 | King |
| 4,589,134 | A | | 5/1986 | Waldron |
| 4,776,044 | A | | 10/1988 | Makins |
| 4,802,638 | A | | 2/1989 | Burger et al. |
| 4,858,248 | A | | 8/1989 | Goldsmith et al. |
| 4,860,364 | A | | 8/1989 | Giannini |
| 4,864,619 | A | | 9/1989 | Spates |
| 4,876,724 | A | | 10/1989 | Suzuki |
| 5,148,002 | A | | 9/1992 | Kuo et al. |
| 5,212,734 | A | * | 5/1993 | Tsao ..... 381/388 |
| 5,257,420 | A | | 11/1993 | Byrne |
| 5,265,165 | A | | 11/1993 | Rauch |
| 5,329,592 | A | | 7/1994 | Altman |
| 5,410,746 | A | | 4/1995 | Gelber |
| 5,438,698 | A | | 8/1995 | Burton et al. |
| 5,444,462 | A | | 8/1995 | Wambach |
| 5,546,609 | A | | 8/1996 | Rush |
| 5,563,951 | A | | 10/1996 | Wang et al. |
| 5,581,821 | A | | 12/1996 | Nakano |

(Continued)

FOREIGN PATENT DOCUMENTS

CN ZL200920132504.3 3/2010

(Continued)

OTHER PUBLICATIONS

O'Neill 4th Generation Clothing Line, http://www.crunchwear.com/oneill-4th-generation-clothing-line/, 2010, 10 pgs, Intelligent Clothing.

(Continued)

*Primary Examiner* — Huyen D Le
(74) *Attorney, Agent, or Firm* — Lawrence S. Cohen

(57) ABSTRACT

An audio source device may be used with a garment such as a hooded garment by passing the audio wires into a channel in the hood and having them exit the hood inside hollow lanyards with earbuds at the ends. A means to fix the wires and the lanyards to each other inside the hood is shown; and a means is shown to prevent lateral movement inside the hood.

14 Claims, 10 Drawing Sheets

U.S. PATENT DOCUMENTS

| | | | | |
|---|---|---|---|---|
| D378,158 | S | 2/1997 | Casey | |
| 5,600,730 | A | 2/1997 | Kenning et al. | |
| 5,606,303 | A | 2/1997 | Suski | |
| D384,791 | S | 10/1997 | Juergens | |
| 5,757,929 | A | 5/1998 | Wang et al. | |
| 5,798,907 | A | 8/1998 | Janik | |
| 5,864,481 | A | 1/1999 | Gross et al. | |
| 5,881,390 | A | 3/1999 | Young | |
| 5,886,739 | A | 3/1999 | Winningstad | |
| 5,912,653 | A | 6/1999 | Fitch | |
| 6,260,202 | B1 | 7/2001 | Villalobos et al. | |
| 6,356,437 | B1 | 3/2002 | Mitchell et al. | |
| 6,507,486 | B2 | 1/2003 | Peterson | |
| 6,535,102 | B2 | 3/2003 | Marmaropoulos | |
| 6,561,814 | B2 | 5/2003 | Tilbury et al. | |
| 6,563,424 | B1 | 5/2003 | Kaario | |
| 6,707,922 | B2 | 3/2004 | Tilbury et al. | |
| 6,753,756 | B2 | 6/2004 | Marmaropoulos | |
| 6,755,795 | B2 | 6/2004 | Marmaropoulos et al. | |
| 6,792,124 | B2 | 9/2004 | Tilbury et al. | |
| 6,818,816 | B2 | 11/2004 | Roberts et al. | |
| 6,826,782 | B2 | 12/2004 | Jordan | |
| D506,594 | S | 6/2005 | Corris | |
| 6,970,691 | B2 | 11/2005 | Thompson | |
| 7,013,492 | B2 | 3/2006 | Hugh et al. | |
| 7,023,338 | B1 | 4/2006 | Foth | |
| 7,173,437 | B2 | 2/2007 | Hervieux et al. | |
| 7,174,196 | B2 * | 2/2007 | Matsuda | 455/575.6 |
| 7,251,332 | B2 | 7/2007 | Eves | |
| RE40,613 | E | 1/2009 | Jordan | |
| 7,519,192 | B1 | 4/2009 | Laycock et al. | |
| 7,673,348 | B2 | 3/2010 | Williams | |
| 2002/0076949 | A1 | 6/2002 | Tilbury et al. | |
| 2002/0132616 | A1 | 9/2002 | Ross et al. | |
| 2002/0197960 | A1 | 12/2002 | Lee et al. | |
| 2003/0019015 | A1 | 1/2003 | Hugh et al. | |
| 2005/0069147 | A1 | 3/2005 | Pederson | |
| 2005/0095406 | A1 | 5/2005 | Gunzel et al. | |
| 2005/0268907 | A1 | 12/2005 | McFarlane | |
| 2006/0062413 | A1 | 3/2006 | Wehrell | |
| 2006/0075537 | A1 | 4/2006 | Tsai | |
| 2006/0088178 | A1 | 4/2006 | Whelen | |
| 2006/0099864 | A1 | 5/2006 | Crumrine et al. | |
| 2006/0117453 | A1 | 6/2006 | Hood | |
| 2006/0147052 | A1 | 7/2006 | Wikel et al. | |
| 2006/0185062 | A1 | 8/2006 | Peng et al. | |
| 2006/0251283 | A1 | 11/2006 | Yeh | |
| 2006/0280322 | A1 | 12/2006 | Abe | |
| 2007/0226871 | A1 | 10/2007 | Hood | |
| 2008/0151179 | A1 | 6/2008 | Howell et al. | |
| 2009/0262967 | A1 | 10/2009 | Bryan | |
| 2011/0019861 | A1 | 1/2011 | Wolfe | |
| 2011/0129110 | A1 | 6/2011 | Wolfe | |

FOREIGN PATENT DOCUMENTS

| | | |
|---|---|---|
| JP | 2000119911 | 4/2000 |
| WO | WO 90/04931 | 5/1990 |
| WO | WO 03/073880 | 9/2003 |

OTHER PUBLICATIONS

Hanlon, M., Motorola and Burton unveil Bluetooth Snowboarding Jacket, Helmet and Beanie, http://www.gizmag.com/go/3598/, accessed on Jul. 22, 2010, 4 pgs, gizmag.

Hanlon, M., Bluetooth MP3 Snowboarding Jacket from O'Neill, http:// www.gizmag.com/go/2520/, 4 pgs, gizmag.

Bluetooth MP3 Snowboarding Jacket from O'Neill Image 3 of 11, http://www.gizmag.com/go/2520/picture/4133/, accessed on Jul. 22, 2010, 2 pgs, gizmag.

Bluetooth MP3 Snowboarding Jacket from O'Neill Image 2 of 11, www.http://www.gizmag.com/go/2520/picture/4132/, accessed on Jul. 22, 2010, 2 pgs, gizmag.

Rohde, L., Jacket Features Built-in MP3 Player, http://www.pcworld.com/article/114311/jacket_features_builtin, Jan 14, 2004, 3 pgs, PCWorld Communications, Inc.

O'Neill Unveils 'The Hub' Snowboard Jacket with Bluetooth, http://www.cellular.co.za/technologies/bluetooth/oneil/oneill_hub-jacket.htm, Jan. 16, 2004, 5 pgs, WC.

Lugmayr, L., Infineon Bluetooth Snowboard Jacket, http://www.i4u.com/ article1252.html, Mar. 8, 2004, 3 pgs, I4U LLC.

Snowboarding Jacket with Built in Phone Controls, http://www.i4u.com/ article1252.html, Jan. 15, 2004, 2 pgs, cellular-news.

Rubin, J., O'Neill Hub, http://www.cellular-news.com/story/10430.php, Jan. 14, 2004, 9 pgs, Captain Lucas, Inc.

Hoodies with Built in CD Player, http://www.halfbakery.com/idea/Hoodies_20with_20Built_20in_20CD_20Player, Jan. 16, 2005, 2 pgs.

Headphone Toque, http://www.halfbakery.com/idea/Headphone_20Toque, Jan. 17, 2005, 2 pg.

Robertson, H., Sound Advice: Hiding Microphones, http://www.videomaker.com/article/9346/, May 2003, 3 pgs, Videomaker, Inc.

Seymour, S., Intelligent Wearables—The Future is Now?, Profile, Dec. 2004, 3 pgs.

The O'Neill Hub Has Arrived, http://forum.surfermag.com/forum/showflat.php? Cat=&Number=551213&page=0&view=collapsed& . . . , Sep. 1, 2004, 2 pgs, Surfer Magazine.

Momphard, D., Tech Reviews, http://www.taipeitimes.com/News/feat/archives/2004/07/11/2003178606, Taipei Times, Jul. 11, 2004, 3 pgs, The Taipei Times.

Dittrich, K., Welcome to electronica's Wearable Technologies special exhibition, WT News, Nov. 14, 2006, 8 pgs, No. 1/2006, Germany.

* cited by examiner

GARMENT WITH BUILT-IN AUDIO SOURCE WIRING

FIELD OF THE INVENTION

The invention is in the fields of clothing and wiring for listening to portable audio sources such as MP3 players, CD players, cell phones and the like. In particular for combinations of clothing and such wiring.

BACKGROUND

Wiring assemblies for portable audio sources for listening are ubiquitous. They are generically called headphones. One type of headphones adapted for portable use are called earbuds or earphones. They have at one end a connector to plug into a source device. This then leads to a pair of wires connected to the devices to be placed at the user's ears, usually held in or on the ear.

A user carries the wiring assembly with her and connects it up to the source device and sets the headphones at the ears. The wiring has to be carried and kept available for use, and it is commonly a nuisance to find it and then to use it. In use it is kept usually outside the clothing, the headphones being at the ears and the audio device held in the hand or placed in a pocket.

The wiring may not be waterproof, but recently waterproof wiring has been developed and is available.

DETAILED DESCRIPTION OF THE INVENTION

In the present invention wiring for an audio device, including headphones and earphones are permanently installed into a garment.

Figure 1:
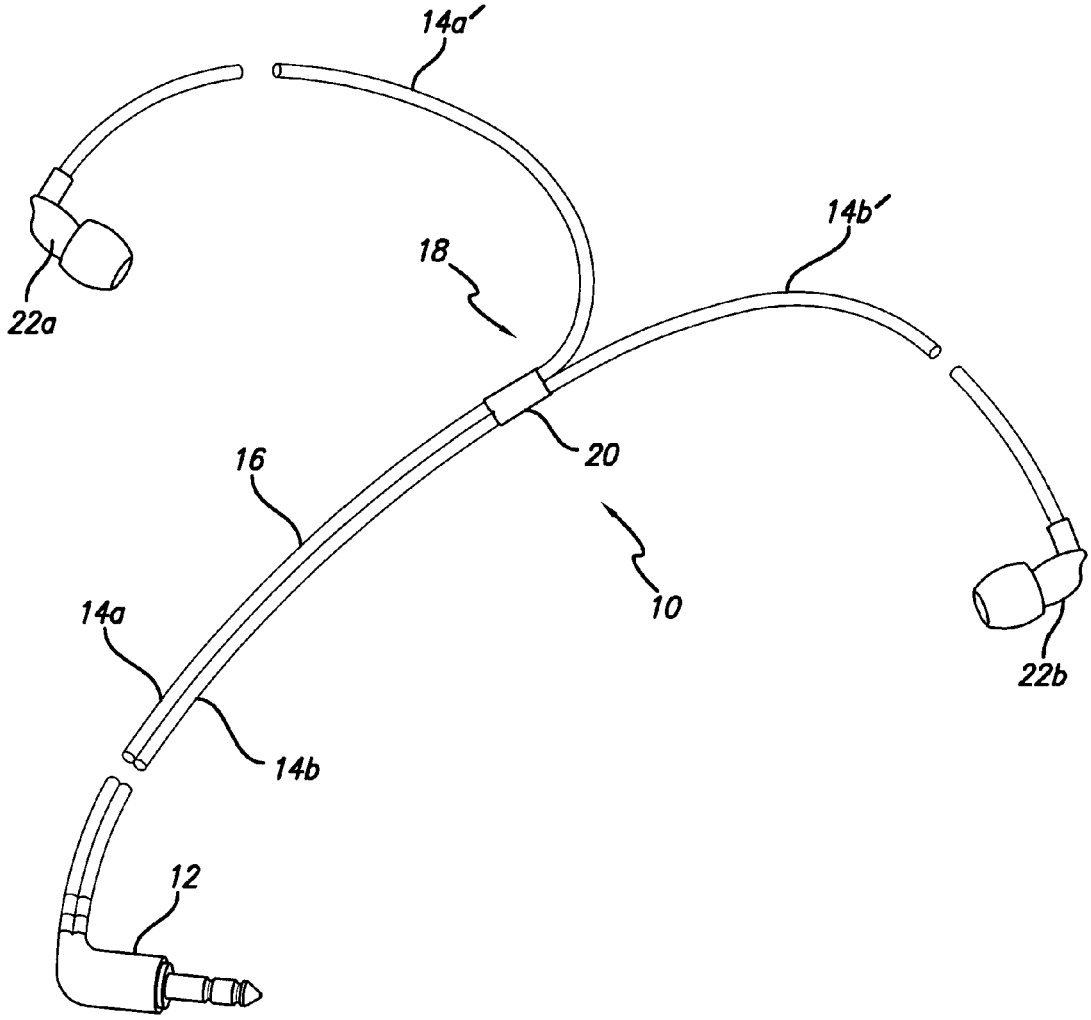
FIG. 1 is a view of an exemplary type of earphones and wiring which is applicable to the present invention.

An exemplary earphone wiring assembly 10 as in FIG. 1 is of the type including a connector 12 for connecting to an audio source device, typically with paired analog audio transmission wires 14*a* and 14*b* joined together along a joined wire portion 16 for some distance to a separation point 18 typically having a strain relief member 20 from which the transmission wires 14*a*' and 14*b*' extend separately terminating at the earphones 22*a* and 22*b*. While the term earphone wiring will be used in this description it is intended to mean any of the type with a connection to a source device and a pair of listening instruments, one for each ear. Typically an analog signal travels from the source device to the earphones.

Figure 2:
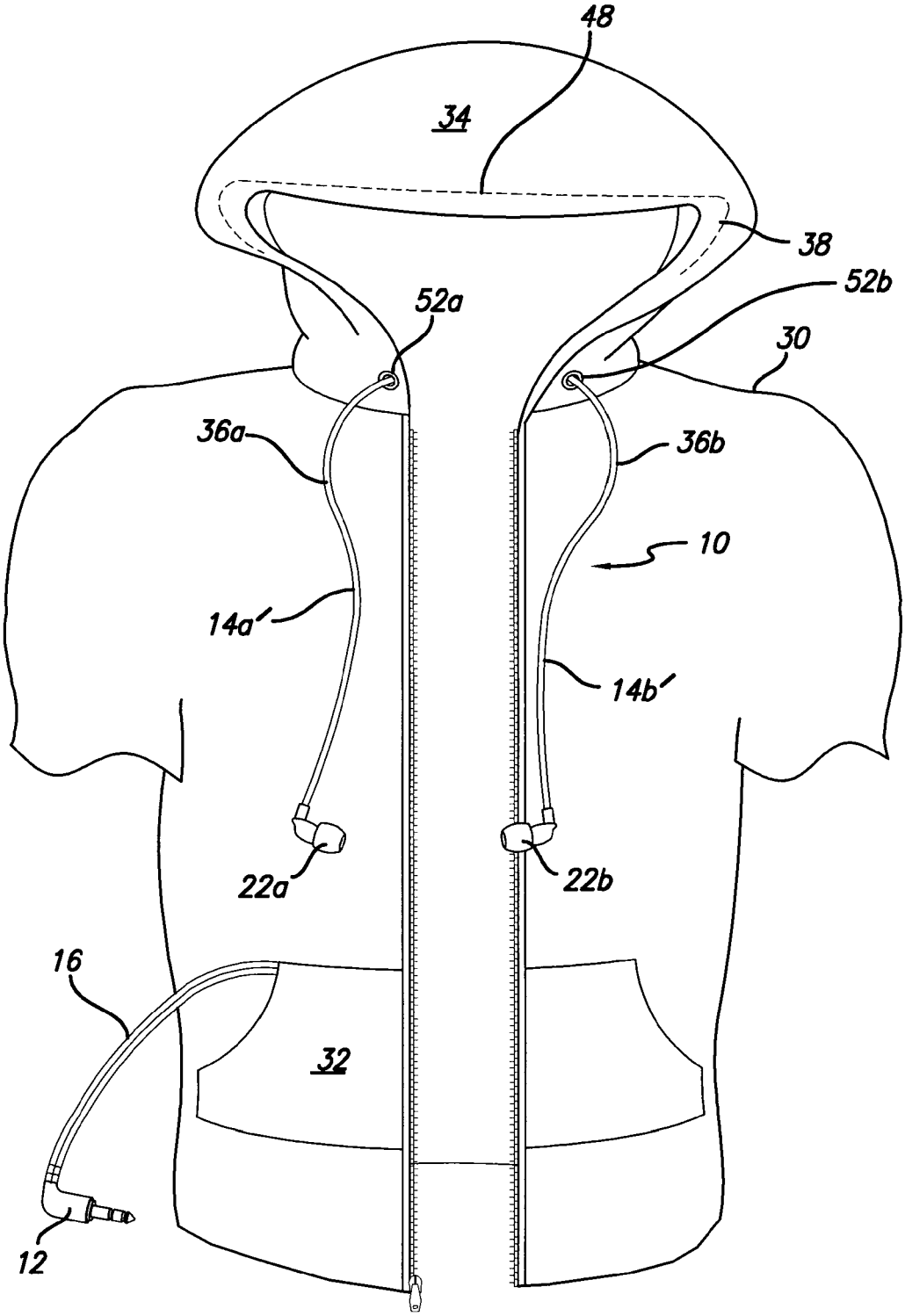
FIG. 2 shows a front view of a hooded garment with earphone wiring built into it according to an embodiment of the invention.
Figure 3:
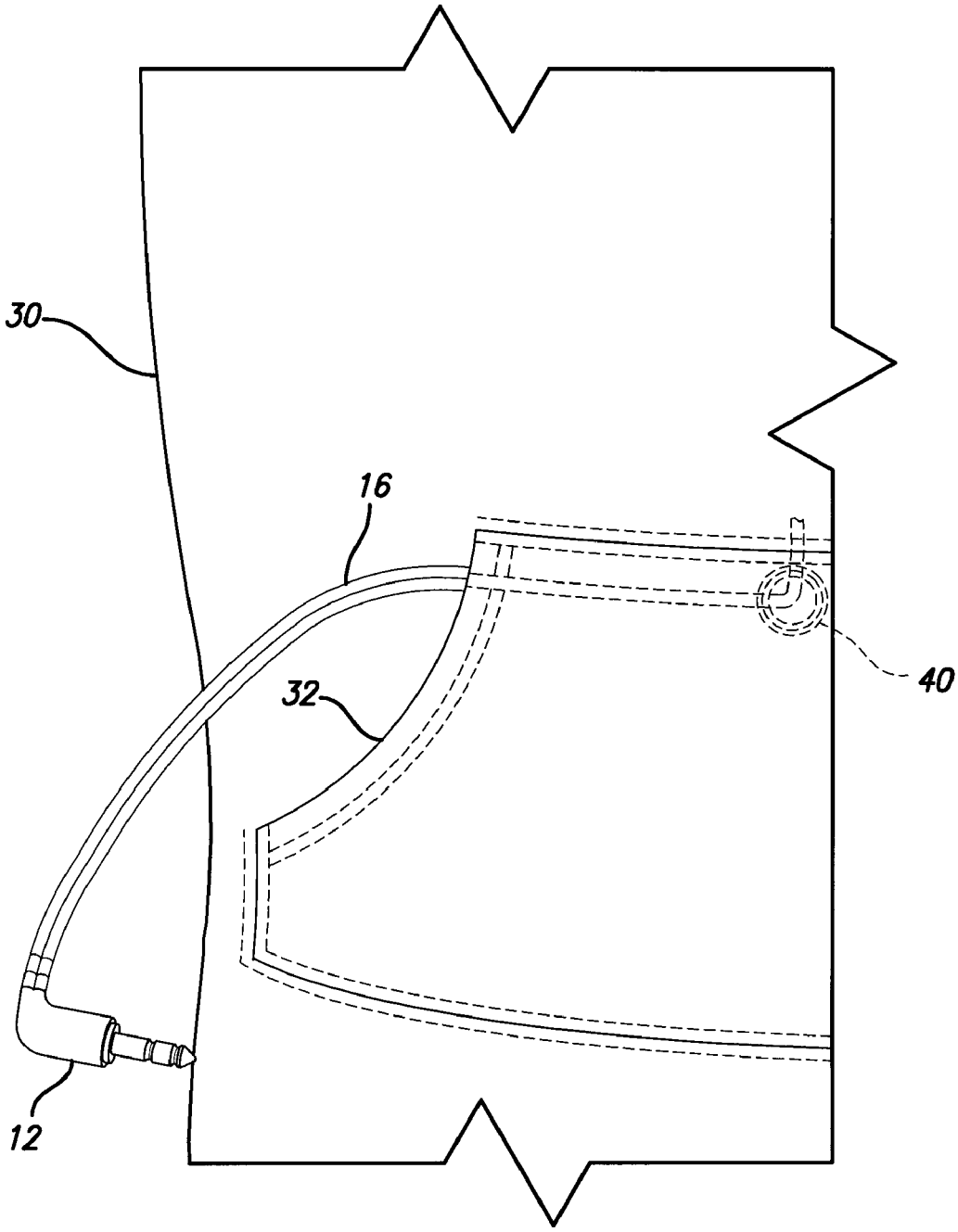
FIG. 3 shows a partial view of a garment showing the connector and access wiring extending into a garment pocket.

In exemplary form the garment is a hooded garment 30 as shown in FIG. 2. In other exemplary forms the garment is a conventionally collared shirt, and in still others it has a plain hemmed neck such as a crew neck. In the case of the hooded garment, it may be in jacket form, that is open down the front (with a zipper or other closure means) or in pull-over form like a sweater. However in each case for purposes of embodiments of this invention there is a channel or casing as will be described. In this description the terms left and right refer to the wearer's left and right. As shown in FIG. 2, the earphone wiring 10 is installed into the garment so that the connector 12 is accessible near a pocket 32 and the right and left earphone wires 14*a*' and 14*b*' exit the garment inside hollow lanyards (also called drawstrings) 36*a* and 36*b* on each side of the hood 34 near the user's ears terminating at the right and left earphones 22*a* and 22*b*. As will be described in more detail below, the portions of the earphone wiring 10 from the connector 12 to which access is not needed and which runs up to the hood 34 is captured in the garment. Also shown in FIG. 2 are right and left tubular lanyards 36*a* and 36*b*. These are used to cover the earphone wires 14*a*' and 14*b*' and also as the hood lanyards, for adjusting (called cinching) the hood 34. The hollow lanyards are knitted or may be hollow flexible plastic FIG. 3 shows an example of how the wire portion 16 extends into the pocket 32 and exits the inner wall of the pocket 32 through an opening 40 so that it is in the inside of the garment 30, as further described below with reference to FIG. 4

Figure 4:
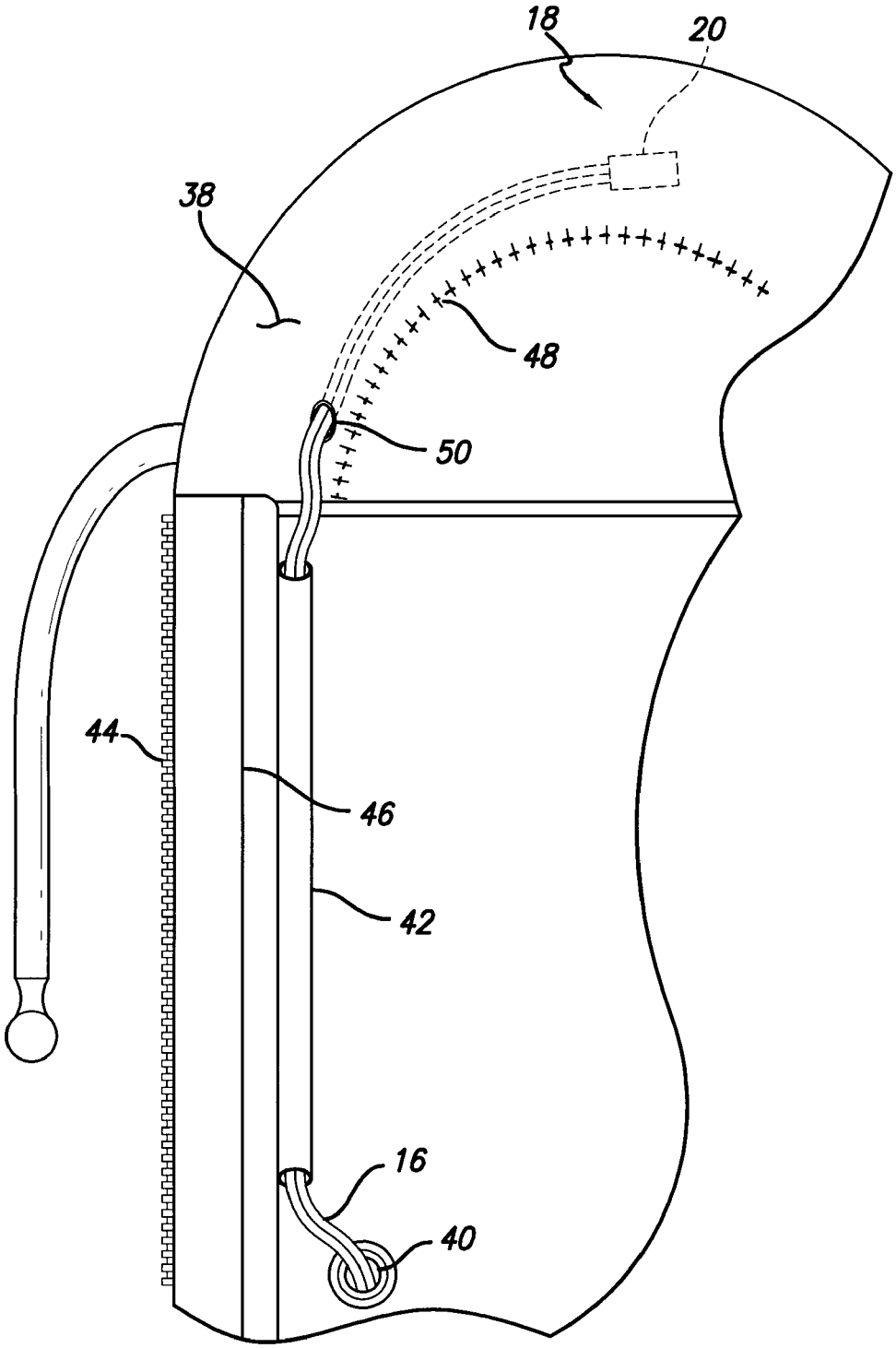
FIG. 4 shows a partial view of a garment with the wiring in a tube sewn into the inside of a garment and entering the channel of the hood.

FIG. 4 shows an example of how the earphone wiring 16 is brought from a location inside the pocket 32 into the hood channel 38. This is done by passing the joined wire portion 16 through an opening 40 inside the pocket, which opening can be a button hole or a grommet to the inside of the garment. Then it enters a first, lower end of and travels through a channel or casing 42 which is sewn into the inside of the garment, in this case along the stitch line 46 that also attaches a zipper 44. Then it exits the channel 42 at a second, upper end, and enters the hood channel 38 (also called a casing) which is defined by the stitching 48, through an opening 50 defined by a button hole or other hole device such as a grommet, entering on the side of the hood channel 38 which is on the interior of the hood 34 and extends to the separation point 18 at which the wires separate. Further detail inside the hood channel 38 is described below.

Installation of the wiring can be done with a garment that does not have a pocket, in which case the wiring can simple extend beyond the bottom of the garment, or it can pass through an opening in the garment.

Figure 5:
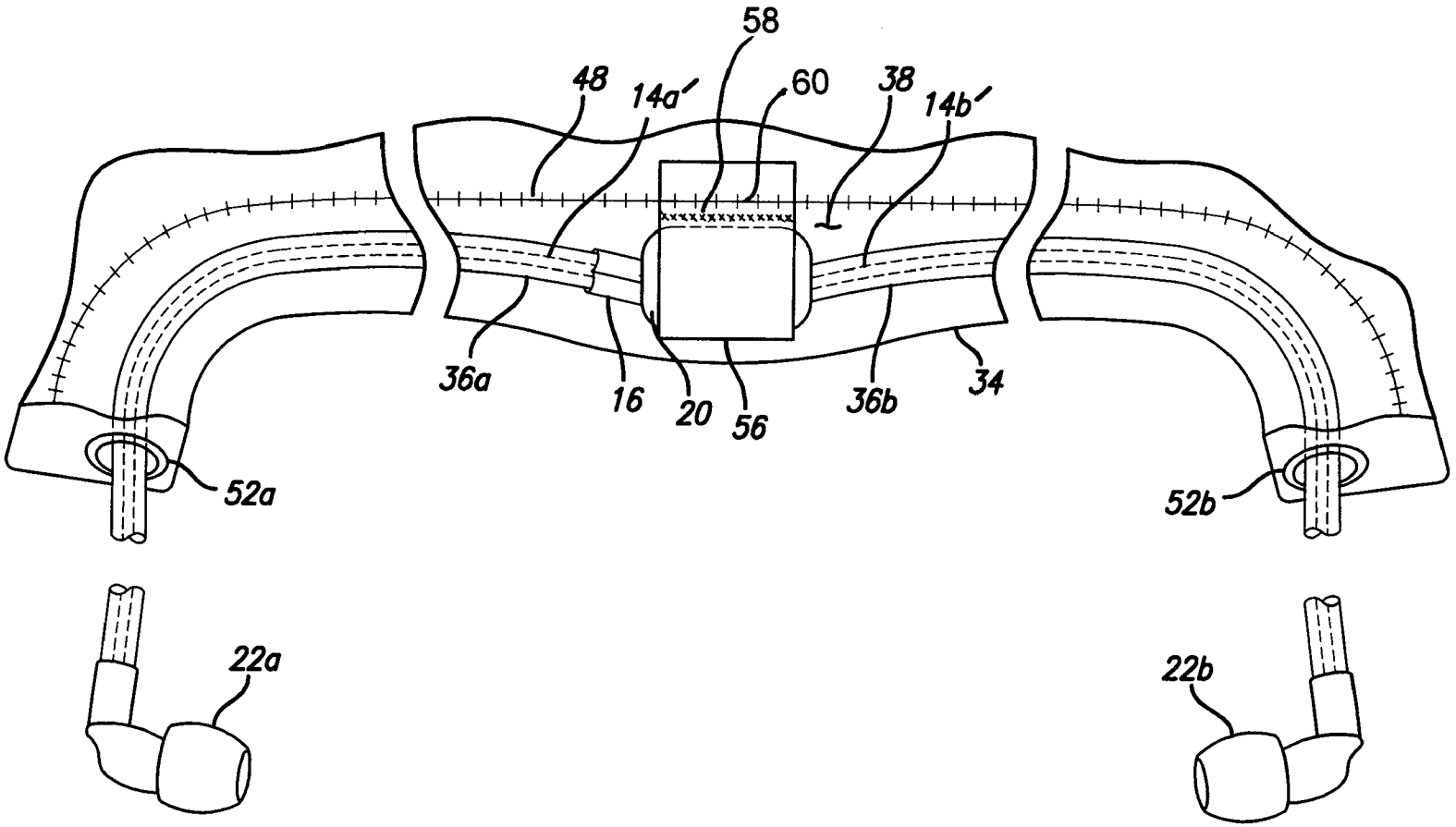
FIG. 5 shows a partial view of a garment with a hood showing a cut-away view of the interior of the inside the channel of the hood with the wiring.

FIG. 5 shows a view of the inside of the hood channel 38 with a portion cut-away to show the interior of the channel. The joined portion 16 comprising the wires 14*a* and 14*b* enters the hood channel 38 as described above with reference to FIG. 4, and this portion is placed so that the strain relief member 20 at which they separate is approximately at the center of the hood 34. The right and left separate wires 14*a*' and 14*b*' are installed inside the right and left hollow lanyards 36*a* and 36*b* respectively. The assembly at the point where the wires 14*a*' and 14*b*' exit the strain relief 20 into the hollow lanyards 36*a* and 36*b* is described in FIGS. 6-8 below. The right and left hollow lanyards 36*a* and 36*b* with the right and left wires 14*a*' and 14*b*' respectively, inside them exit the hood channel 38 through openings 52*a* and 52*b*, which in this embodiment are on the outside of the hood channel 38, although they could be on the inside.

Figure 6:
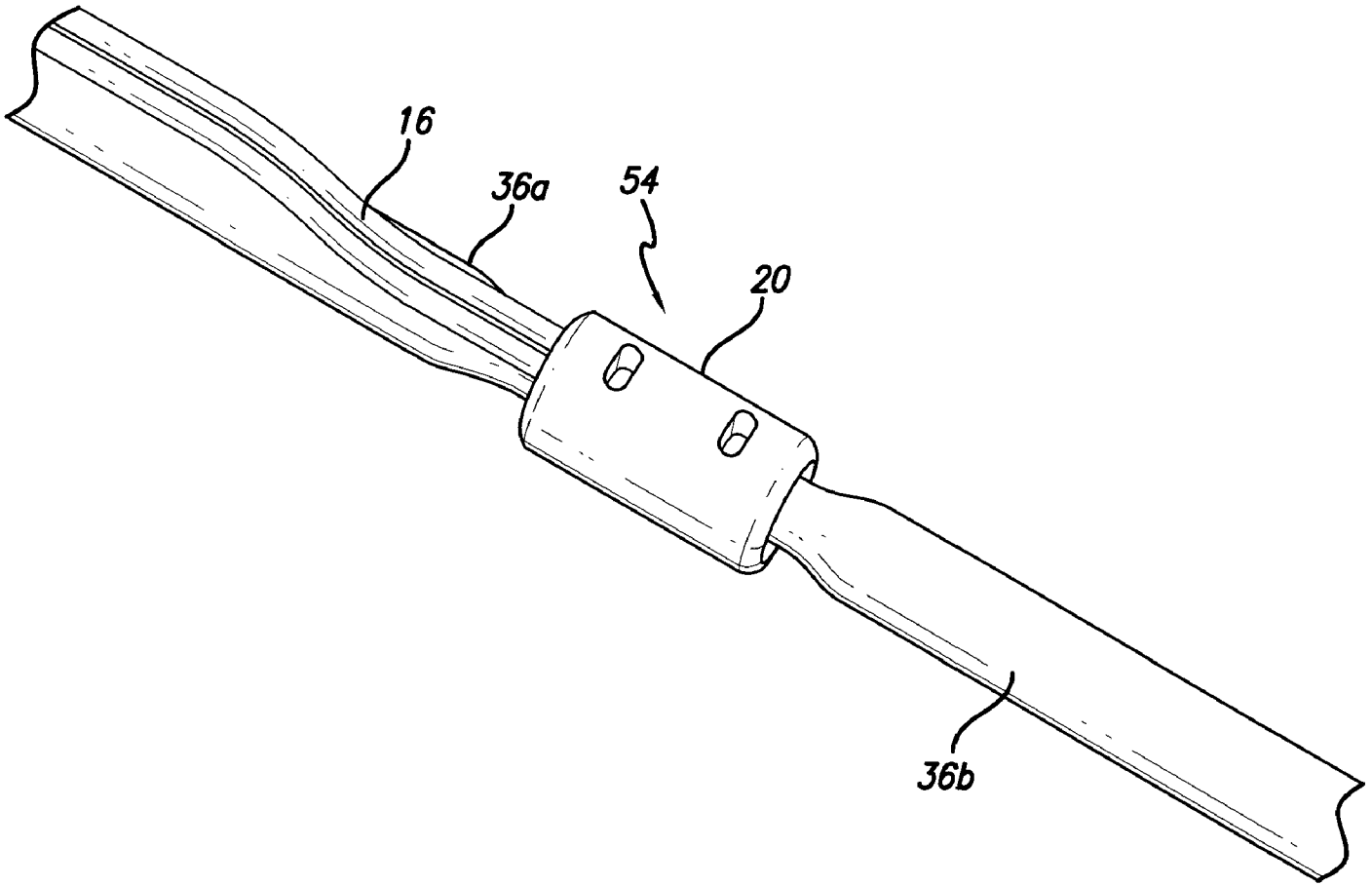
FIG. 6 shows the wiring and hollow lanyards as held together in the channel by a barrel.

FIG. 6 shows an embodiment for a secure "Y" connection of the wires inside the hood channel 38. In this embodiment the strain relief also called a securing piece 20 is a plastic barrel that has been molded over the separation point 18 where the joined wires 14*a* and 14*b* separate into the separate wires 14*a*' and 14*b*'. It is also at this point that the wires 14*a*' and 14*b*' enter the hollow lanyards 36*a* and 36*b* respectively. The securing device 20 tightly holds the ends of the lanyards with respect to each other and the wires. This will be referred to as the securing point 54.

Figure 7:
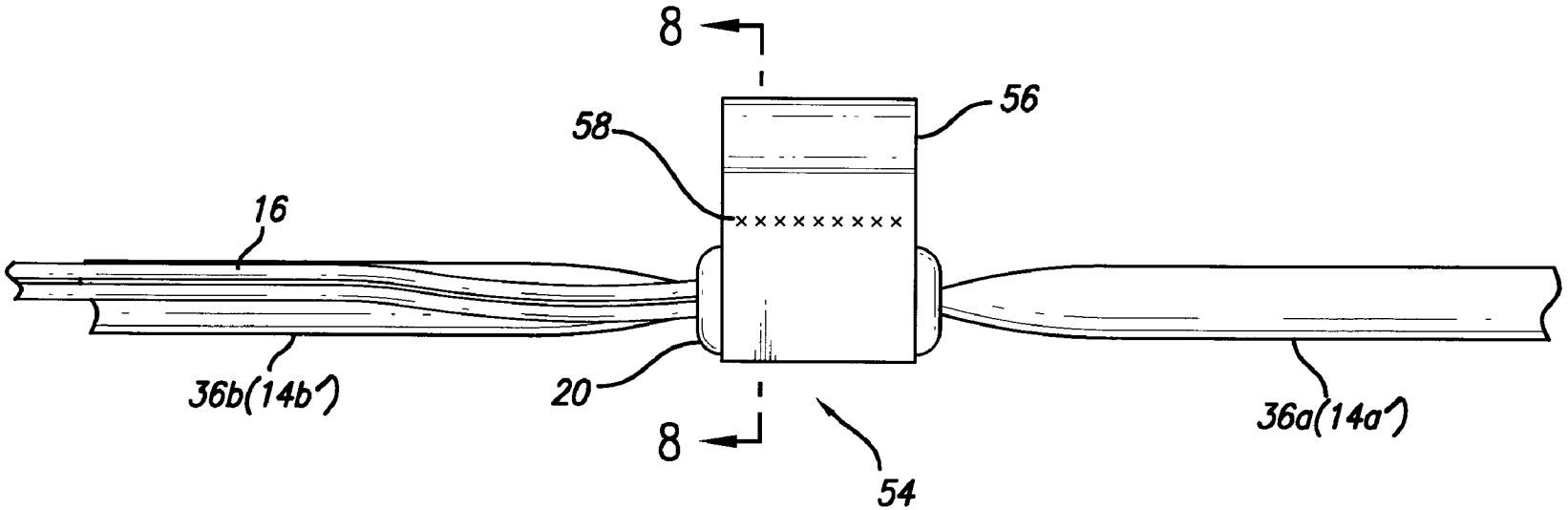
FIG. 7 is a view showing the wiring and hollow lanyards with a tab attached to the barrel for fixing to the garment.
Figure 8:
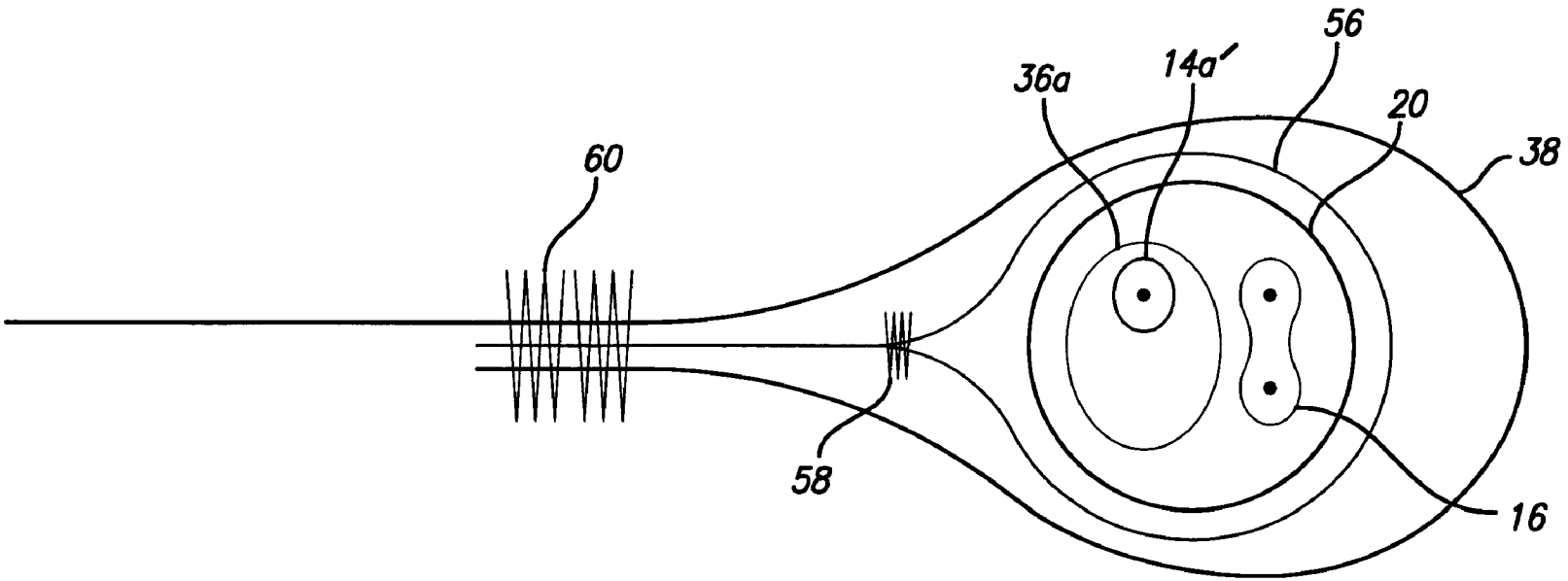
FIG. 8 is a section view at 8-8 of FIG. 7 showing the wiring and hollow lanyards fixed to the casing by means of the tab.

It is preferable that the lanyards 36*a* and 36*b* with the wires inside them be attached to the garment inside the hood channel 38 to avoid pulling them laterally in one direction or the other such as by uneven pulling. There are various ways that this can done. One way is to secure the assembly to the garment at or near the securing point 54. In one embodiment this is done as shown in FIGS. 5, 7 and 8 with a fabric strip 56 secured around the securing piece 20, stitching and gluing being exemplary. It is then co-sewn into the hem stitch 46 which defines the casing or channel 38. The detail is shown in FIG. 8 in which the fabric strip 56 is sewn at 58 to help secure it around the securing piece 20. Then, after it has been set in place, it is co-sewn with the hood channel hem as shown at 60.

Figure 10:
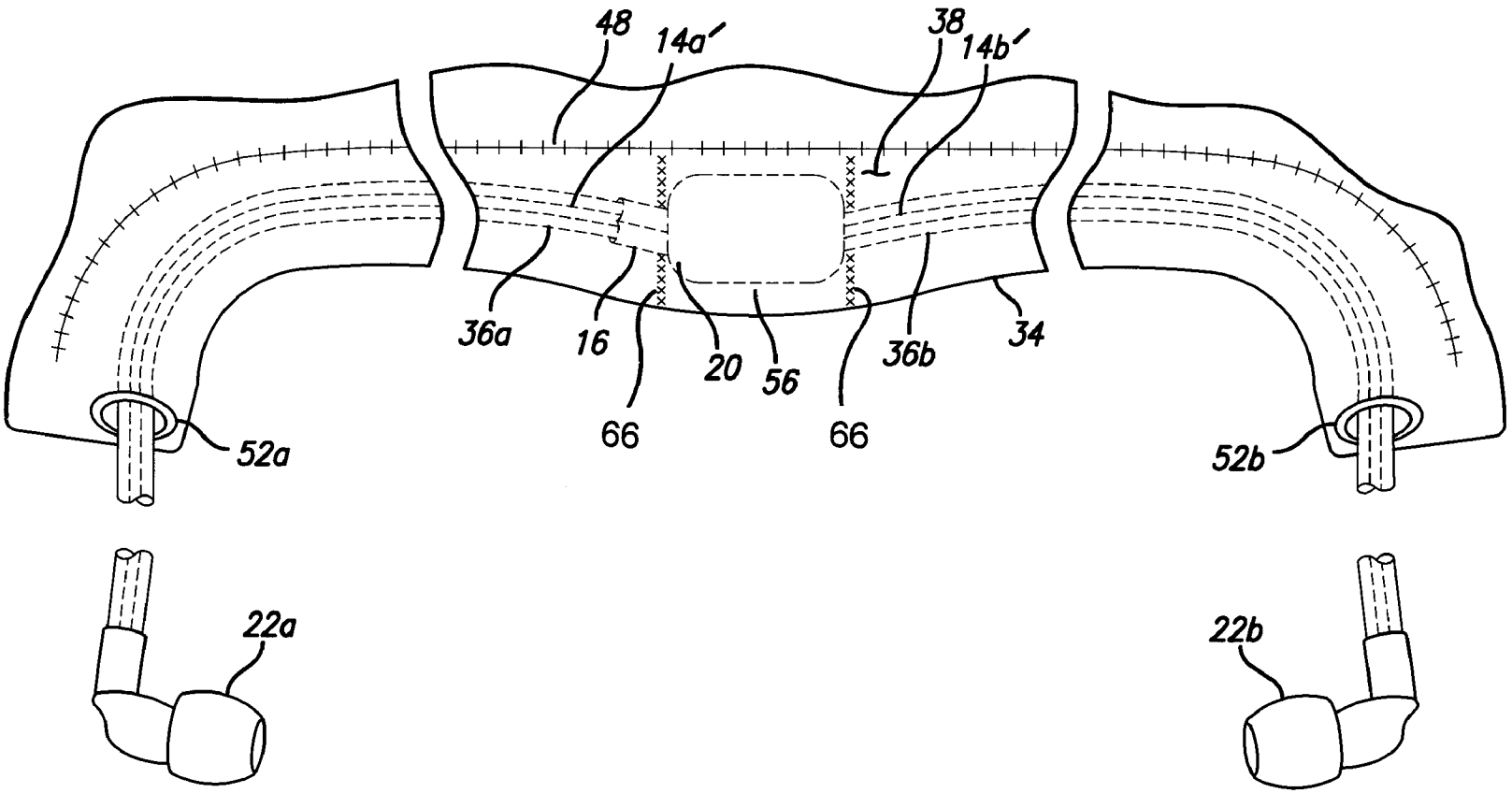
FIG. 10 is a view of the channel portion of a hooded garment showing the wiring inside it and an alternative way of fixing the wiring and lanyards against lateral movement

FIG. 10 shows another embodiment for fixing the lanyard/wire members against lateral movement. In this embodiment, the securing piece 20 is captured between stitch lines 66 on either side. Of course the stitch lines 66 have to avoid the wiring.

As explained above, an embodiment of the invention combines the hood lanyards 36*a* and 36*b* with the separate wire portions 14*a*' and 14*b*' so that the hollow lanyards serve two purposes, one is to tighten the hood, and secondly as conduits for the separate wire portions 14*a*' and 14*b*'. The ends of the lanyards 36*a* and 36*b* are secured to the earphones 22*a* and 22*b*, which in the figures are shown as the earbuds type of earphones.

Figure 9A:
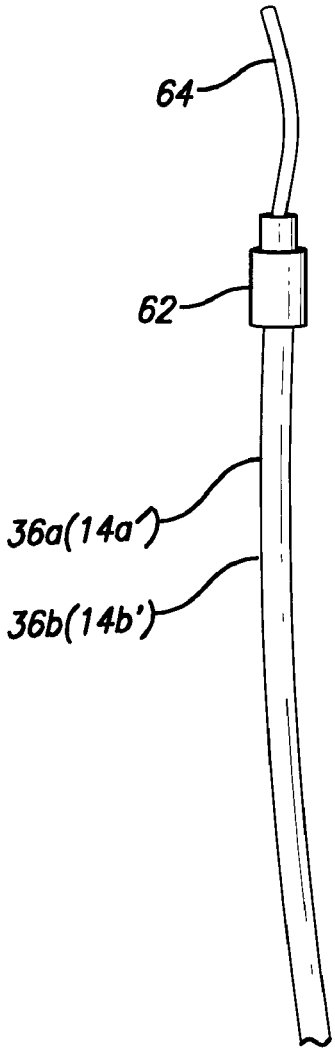
FIG. 9*a* is a view of the hollow lanyard with the electrical wire and a connection fitting for connection to an earbud.
Figure 9B:
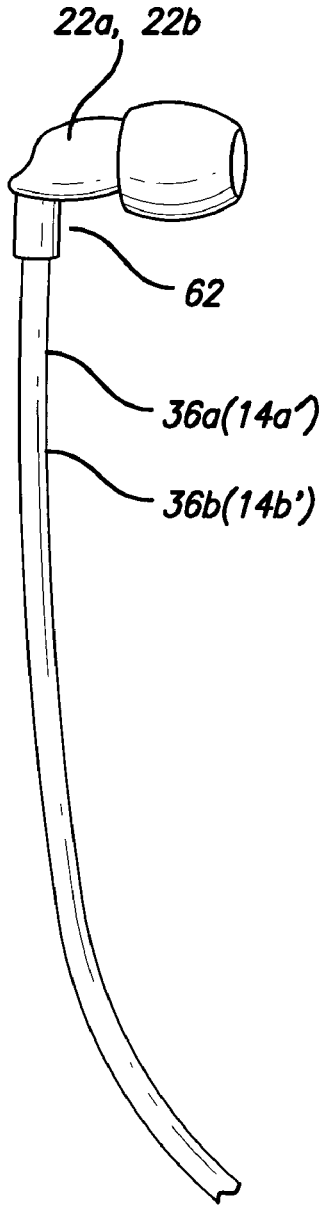
FIG. 9*b* is a view showing the assembled fitting to the earbud.

To manufacture the assembly so that the wiring is permanently installed in the garment, the separate wires 14*a*' and 14*b*' are first strung through the lanyards 36*a* and 36*b*. Then the molded barrel 20 is molded into place at the "Y" junction securing point 54 joining the wires and the lanyards at one end. Then the other ends of the combined lanyards and wires are crimped to a strain relief connection fitting 62 as shown in FIG. 9*a*, and then the stripped wire portion 64 is attached to the earbuds 22*a* and 22*b* and the connection fitting 62 is secured to the earbuds 22*a* and 22*b* as shown in FIG. 9*b*.

While in this description, the terms right and left have been used to understand the location of the lanyards, the wires and the earphones with respect to the garment; it should be understood that the location may but does not necessarily consistently apply to the attachment to a user's left and right ear. A user may attach the left earphone to the left ear and the right earphone to the right ear. But a user can elect to do the opposite; and when the lanyards are tied in a conventional bow, the left and right earphones will reverse their relative location.

The foregoing Detailed Description of exemplary and preferred embodiments is presented for purposes of illustration and disclosure in accordance with the requirements of the law. It is not intended to be exhaustive nor to limit the invention to the precise form or forms described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. This disclosure has been made with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising step(s) for . . . "

The invention claimed is:

1. A combination of a garment and wiring for an audio source device comprising:

a garment having a hood defined by a hood channel; and left and right lanyard portions extending from an entry end inside the hood channel and terminating at an exit end outside the hood channel on the left and right sides of the hood for cinching the hood, audio connection wiring comprising a source access connector and left and right wires from the connector to left and right earphones respectively at the end of each one of the pair of wires;

the wires being assembled into the garment so that the connector is available at a selected location exteriorly of the garment for connecting to an audio source device and the earphones are available for placing at a user's ears;

the audio connection wiring having a first portion extending from the connector of which first portion pair of wires are joined, up to a separation point at which they separate into the separate left and right wires terminating in the respective left and right earphones; and the first portion passing from outside the garment to the inside of the garment and extending interiorly of the garment in a transfer channel and then into the hood channel and the point of separation is inside the hood channel; and the separated left and right wires extending inside the respective left and right lanyard portions to each side of the hood channel and extending beyond the exit end of the respective lanyard;

whereby the earphones can be inserted into a user's ears and an audio device can be connected to the connector and the lanyards with the separate left and right wires inside them can be used to cinch the hood.

2. The combination of claim 1 further comprising a securing element at the separation point the securing element gripping the combined wires and the entry ends of the lanyards and the separated wires inside the lanyards so that all of them are immovable with respect to the others.

3. The combination of claim 2 wherein the transfer tube is attached to the garment by sewing it along its length at least in part commonly with other stitching for the construction of the garment.

4. The combination of claim 3 wherein the wires extend from the connector inside a pocket of the garment and therefrom to the garment interior.

5. A combined garment and earphones comprising:

a garment having a hood adapted for being worn over a user's head, the hood including a hood channel for cinching;

a combination lanyard portion and wiring assembly comprising;

a lanyard portion comprising a hollow left lanyard element and a hollow right lanyard element each extending from an entry end inside the hood channel to an outside end outside the hood channel;

a wiring assembly comprising left and right earphone wires entering the lanyard portion inside the hood channel and extending respectively inside the left lanyard element and the right lanyard element and exiting the outside end of the respective lanyard and extending a distance outside its respective lanyard element and terminating at left and right earphones.

6. The combined garment and earphones of claim 5 further comprising:

the earphone wires extending exiting the hood channel through a common exit opening and extending within a transfer channel fitted interiorly of the garment and the wires exiting the transfer channel at a selected location and terminating in a connector for connection to a signal source.

7. The combined garment and earphones of claim 6 wherein the transfer channel ends proximate a pocket in the garment and the wires extend in the pocket for access for connection to an audio source device.

8. A method of combining audio source wiring with a garment comprising;

providing a garment having a hood with a prospective hood channel portion;

providing two lengths of hollow lanyards defining a left and right lanyard each having an entry end and an exit end;

providing audio connection wiring comprising a connector for connecting to an audio source and left and right wire portions extending to termination ends;

installing portions of the left and right wire through the left and right hollow lanyard respectively from the entry end and the termination ends of the wire portions extending beyond the exit end of the hollow lanyard;

arranging the entry ends of the hollow lanyards to be proximate each other and securing them together;

installing the hollow lanyards into the prospective hood channel portion so that they extend oppositely to the left and right of the prospective hood channel portion; and forming a hood channel with the hollow lanyards inside it and extending beyond the hood channel at the left and right side of the garment respectively whereby the termination ends of the wires also extend beyond the hood channel;

fixing the hollow lanyards inside the hood channel to the garment so that they cannot move lengthwise together with respect to the hood channel.

9. The method of claim 8 further comprising;

fixing the hollow lanyards against said lengthwise movement in the hood channel at a point proximate the center of the hood channel so that each lanyard can be used to cinch substantially half of the hood.

10. The method of claim 9 further comprising;

terminating an earphone at each termination end of the left and right wires whereby the earphones are available outside the hollow lanyards for application to a user's ears when wearing the garment and the lanyards with the wires extending inside them can be used to cinch the hood.

11. The method of claim 8 further comprising concurrently fixing the wire entering each hollow lanyard to the entry end of the lanyard against lateral movement with respect to the hollow lanyard.

12. The method of claim 8 wherein the fixing is provided by surrounding the entry ends with a securing device that can be applied tightly to the entry ends.

13. The method of claim 8 wherein the fixing is provided by attaching a securing element to the entry ends holding them together and sewing across the hood channel proximate left and right ends of the securing element defining a pocket that restrains the securing element against lengthwise movement.

14. The method of claim 12 further comprising concurrently fixing the wire entering the hollow lanyard at the entry end against lateral movement with respect to the hollow lanyard.

* * * * *